US007708457B2

(12) United States Patent
Girardin et al.

(10) Patent No.: US 7,708,457 B2
(45) Date of Patent: May 4, 2010

(54) WATCH WITH A POLYGONAL BEZEL

(75) Inventors: Marielle Girardin, La Chaux-de-Fonds (CH); David Apotheloz, Corcelles (CH); Jean-Claude Gracia, Bienne (CH)

(73) Assignee: Tissot S.A., Le Locle (CH)

( * ) Notice: Subject to any disclaimer, the term of this patent is extended or adjusted under 35 U.S.C. 154(b) by 0 days.

(21) Appl. No.: 12/021,687

(22) Filed: Jan. 29, 2008

(65) Prior Publication Data

US 2008/0181061 A1 Jul. 31, 2008

(30) Foreign Application Priority Data

Jan. 29, 2007 (EP) ..... 07101333

(51) Int. Cl.
*G04B 37/00* (2006.01)
*G04B 39/00* (2006.01)

(52) U.S. Cl. ..... 368/287; 368/295

(58) Field of Classification Search ..... 368/276, 368/294–295, 286–287, 280
See application file for complete search history.

(56) References Cited

U.S. PATENT DOCUMENTS 1,722,514 A * 7/1929 Zullo ..... 368/294
4,034,552 A * 7/1977 Davidson ..... 368/280
4,390,288 A * 6/1983 Arnoux ..... 368/276
4,490,052 A * 12/1984 Gogniat ..... 368/292
RE32,617 E * 3/1988 Gogniat ..... 368/292
5,077,710 A * 12/1991 Gogniat ..... 368/280

FOREIGN PATENT DOCUMENTS

| | | |
|---|---|---|
| CH | 120032 | 8/1926 |
| CH | 667 177 A3 | 9/1988 |
| DE | 233309 | 5/1909 |
| EP | 0 067 120 A1 | 12/1982 |
| FR | 2 502 805 | 10/1982 |

OTHER PUBLICATIONS

European Search Report issued in corresponding application No. EP. 07 10 1333, completed Aug. 30, 2007.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

A watch having a middle part including a top face arranged for receiving a polygonal bezel made of a first material. The corners of the bezel are truncated and the middle part is fitted with angular elements made of a second material, secured to the top face thereof, and arranged so as to be substituted for the truncated corners of the bezel when the latter is mounted on the middle part.

7 Claims, 1 Drawing Sheet

WATCH WITH A POLYGONAL BEZEL

This application claims priority from European Patent Application No. 07101333.8, filed Jan. 29, 2007, the entire disclosure of which is incorporated herein by reference.

FIELD OF THE INVENTION

The present invention relates to the field of horology. It concerns more specifically a watch including a middle part on which a polygonal bezel of soft or fragile material is mounted.

"Soft material" means a material having a Vickers hardness of less than 30 HV for example wood, certain plastics or even leather. "Fragile material" means a material with no plastic deformation field, such as a ceramic, stone or mother of pearl. More generally, the group of soft or fragile materials is substantially formed of non metallic materials.

BACKGROUND OF THE INVENTION

Watches comprising an exterior made of soft material, such as wood, are known to those skilled in the art for their particularly decorative appearance. In existing embodiments, the case is either entirely formed of wood, or formed of a metal body covered with a wooden cover. Reference can be made, for further information about these embodiments, to Patent Application Nos. DE 233 309 and CH 667 177.

One drawback of the exterior made of soft material is its lack of resistance to wear. Since angular parts, such as corners, are particularly exposed to wear, existing embodiments do not include any, but have rounded shapes. Such watches are consequently limited to circular and oval geometries.

Watches whose exterior is formed of a fragile material are also known. Unlike soft materials, fragile materials are generally quite resistant to wear, but are liable to break at the angular parts. For this reason, circular and oval geometries are also preferred for watches comprising an exterior made of fragile material.

SUMMARY OF THE INVENTION

It is an object of the present invention to overcome these limitations, by proposing a watch fitted with a polygonal bezel made of soft or fragile material, whose corners are resistant to wear and shocks.

More specifically, the invention concerns a watch comprising a middle part including a top face arranged for receiving a polygonal bezel made of a first material, characterized in that the corners of the bezel are truncated and in that the middle part is fitted with angular elements made of a second material secured to the top face thereof and arranged to be substituted for the truncated corners of the bezel when the latter is mounted on the middle part.

In a particularly advantageous embodiment, the second material is more resistant to shocks or wear than the first.

Owing to the angular elements made of a shock or wear resistant material, arranged to be substituted for the corners of the polygonal bezel, any wear or breakage of the corners, which are the major drawbacks of such a bezel, are greatly reduced.

BRIEF DESCRIPTION OF THE DRAWINGS

Other features and advantages of the present invention will appear more clearly from the following detailed description of an example watch according to the invention, this example being given purely by way of non limiting illustration, with reference to the annexed drawings, in which.

DETAILED DESCRIPTION OF THE ILLUSTRATIVE EMBODIMENTS

Figure 1:
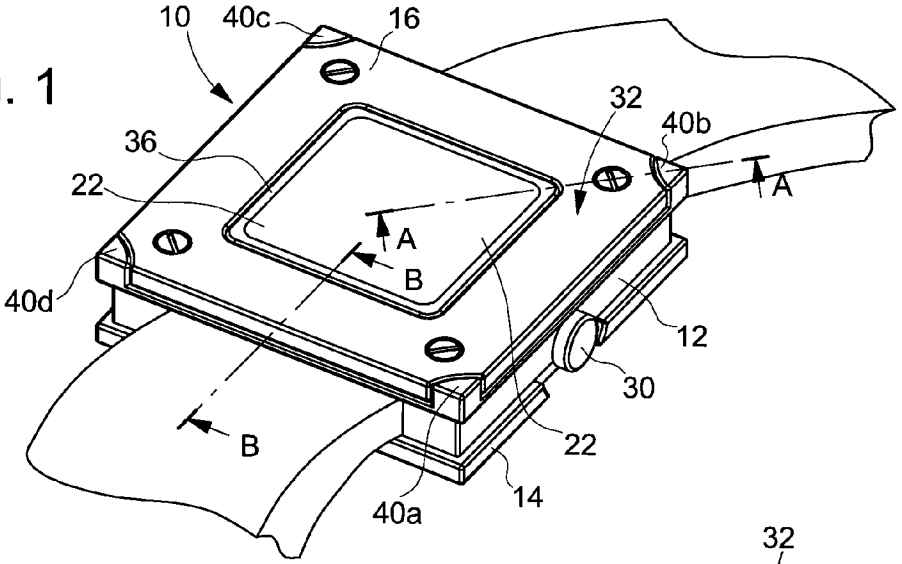
FIG. 1 is a perspective view of the watch according to the invention.
Figure 2:
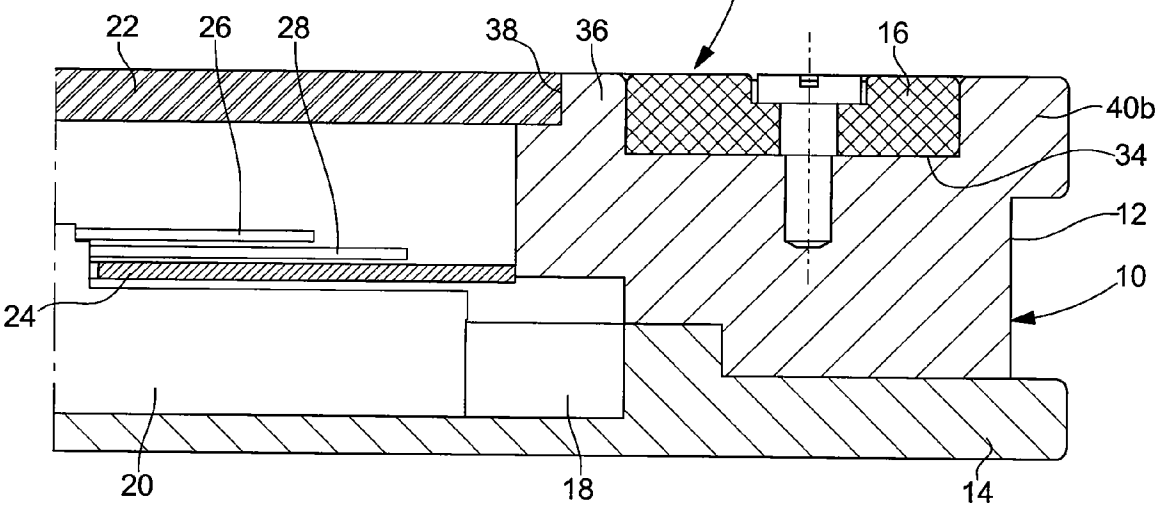
FIG. 2 is a cross-section of the case along a first axis AA.
Figure 3:
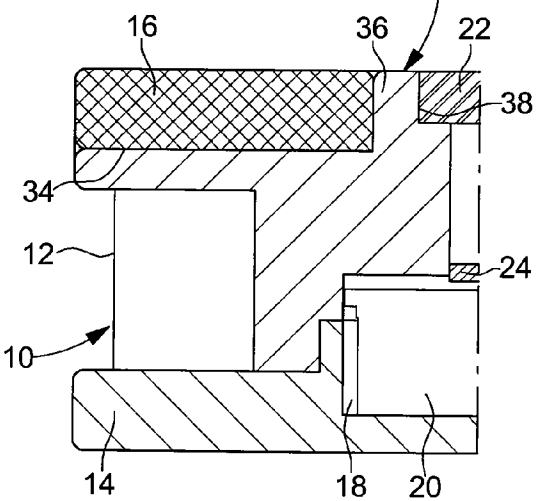
FIG. 3 is a cross-section of the case along a second axis BB.

The watch shown in FIGS. 1, 2 and 3 includes in a conventional manner a case 10, formed of a middle part 12, a back cover 14 and a bezel 16. Middle part 12 defines with back cover 14 a housing 18 containing a movement 20. Movement 20 can be of the mechanical or electromechanical type powered by a battery that is not shown. The watch further includes a crystal 22 mounted on middle part 12, a dial 24 inserted between the movement 20 and crystal 22, and time indication display means, such as hands 26 and 28, kinematically connected to movement 20. A crown 30, secured to a winding stem, located on the side of middle part 12, is for winding and correcting the time indication.

Middle part 12, back cover 14 and bezel 16 have a substantially square geometry. In a variant, middle part 12, back cover 14 and bezel 16 could be of any polygonal shape, for example, rectangular, hexagonal, triangular, etc. Middle part 12 and back cover 14 are formed of a material that resists wear and shocks well, typically a metal, such as steel. The bezel is formed of a soft or fragile material, such as wood, ceramic, mother of pearl or any other non metallic material able to provide a decorative effect.

Middle part 12 includes a top face 32 formed of a substantially plane surface 34 delimited by an inner edge 36 forming a shoulder 38 on which crystal 22 is mounted. Those skilled in the art could choose to mount crystal 22 in a water resistant manner, by inserting a sealing gasket between crystal 22 and middle part 12. The top face 32 further includes four angular elements 40*a, b, c* and *d*, which project relative to surface 34 and are arranged at the four corners thereof. The four elements 40*a, b, c* and *d* form with middle part 12 a monoblock assembly. They are obtained by machining top face 32, or by stamping middle part 12. In a variant, elements 40*a, b, c* and *d* could be added to middle part 12 by brazing, welding, bonding or by screws.

Bezel 16 is positioned on the top face 32 via an edge 36 and screwed to middle part 12 using four screws so as to be pressed against surface 34. In a variant, bezel 16 could be bonded to surface 34. The four corners of bezel 16 are truncated, such that when it is positioned on top face 32 of middle part 12, angular elements 40*a, b, c* and *d* take the place of the four corners. This arrangement prevents the corners of bezel 16 being damaged, either by wear or by a shock.

Thus a watch has been described including a polygonal bezel whose corners resist wear and shocks well. It goes without saying that the present invention is not limited to the embodiment that has just been described, and that various simple alterations and variants could be envisaged by those skilled in the art, without departing from the scope of the present invention as defined by the annexed claims.

What is claimed is:

1. A watch including a middle part including a top face arranged for receiving a polygonal bezel made of a first material, wherein the corners of the bezel are truncated and wherein the middle part is fitted with angular elements made of a second material secured to the top face and arranged to be substituted for the truncated corners of the bezel when the latter is mounted on the middle part, wherein said angular elements form a monoblock piece with the middle part.

2. The watch according to claim 1, wherein said top face includes a substantially plane surface on which the bezel is mounted, and wherein said angular elements project relative to said plane surface.

3. The watch according to claim 1, wherein said first material is non-metallic and said second material is metallic.

4. A watch including a middle part including a top face arranged for receiving a polygonal bezel made of a first material, wherein the corners of the bezel are truncated and wherein the middle part is fitted with angular elements made of a second material secured to the top face and arranged to be substituted for the truncated corners of the bezel when the latter is mounted on the middle part, wherein said second material is more resistant to shocks or to wear than said first material, wherein said angular elements form a monoblock piece with the middle part.

5. The watch according to claim 4, wherein said first material is non-metallic and said second material is metallic.

6. The watch according to claim 4, wherein said angular elements are obtained by machining the top face of the middle part.

7. The watch according to claim 1, wherein said top face includes a substantially plane surface on which the bezel is mounted, and wherein said angular elements project relative to said plane surface.

* * * * *